US006959467B2

(12) United States Patent
Kimmerle et al.

(10) Patent No.: US 6,959,467 B2
(45) **Date of Patent: *Nov. 1, 2005**

(54) BLADED DISK BRUSH ROLLER ASSEMBLY FOR A VACUUM CLEANER

(76) Inventors: William Kimmerle, 250 College St., Hudson, OH (US) 44236; Carl B. Sauers, 276 21st St. NW, Barberton, OH (US) 44203

( * ) Notice: Subject to any disclaimer, the term of this patent is extended or adjusted under 35 U.S.C. 154(b) by 332 days.

This patent is subject to a terminal disclaimer.

(21) Appl. No.: 10/222,673

(22) Filed: Aug. 16, 2002

(65) Prior Publication Data

US 2004/0031124 A1 Feb. 19, 2004

(51) Int. Cl.[7] ..... A47L 9/04
(52) U.S. Cl. ..... 15/383; 15/375; 15/392
(58) Field of Search ..... 15/375, 376, 383, 15/392

(56) References Cited

U.S. PATENT DOCUMENTS

| | | | | |
|---|---|---|---|---|
| 1,323,925 | A | | 12/1919 | Stewart |
| 1,718,293 | A | | 6/1929 | Hoover |
| 1,972,745 | A | | 9/1934 | Martinet |
| 2,085,700 | A | | 6/1937 | Kitto |
| 2,178,003 | A | | 10/1939 | Smellie |
| 4,854,006 | A | | 8/1989 | Nishimura et al. |
| 5,802,666 | A | * | 9/1998 | Jung ..... 15/392 |
| 6,032,327 | A | | 3/2000 | Oka et al. |
| 6,058,561 | A | | 5/2000 | Song et al. |
| 6,079,079 | A | | 6/2000 | Oka et al. |
| 6,314,611 | B1 | | 11/2001 | Sauers |

* cited by examiner

*Primary Examiner*—Theresa T. Snider
(74) *Attorney, Agent, or Firm*—Brouse McDowell; John M. Skeriotis

(57) ABSTRACT

A brush roller assembly for a vacuum cleaner includes a rotatable spindle having a longitudinal axis, a first end, a second end and a central portion. A first airflow enhancing device ("AED") is positioned, by being molded onto or operationally attached to, the first end of the rotatable spindle. The first AED includes a central portion, which is positioned substantially perpendicular to the longitudinal axis of the rotatable spindle when the first AED is positioned on the first end of the rotatable spindle. The first AED includes at least one fan blade projection outwardly extending from the periphery of the central portion of the first AED. The fan blade projection facilitates the movement of debris directly or indirectly from the first end of the rotatable spindle toward the central portion of the rotatable spindle. A second AED device may be positioned on the second end of the rotatable spindle, wherein the second AED has similar structure to and attaches in similar fashion as the first AED. In one embodiment, the housing has a hole in the bottom to enable air to enter the housing, travel down the longitudinal axis and towards the central portion of the rotatable spindle. In another embodiment, the housing may have openings in the sidewalls that promote airflow directly from the outside of the housing to the ends of the rotatable spindle. In yet another embodiment, a pressurized fan is attached to the housing or the rotatable spindle to increase forced airflow.

8 Claims, 13 Drawing Sheets

BLADED DISK BRUSH ROLLER ASSEMBLY FOR A VACUUM CLEANER

I. BACKGROUND OF THE INVENTION

A. Field of Invention

The present invention relates generally to new and novel improvements in a bladed disk brush roller assembly for a vacuum cleaner. More particularly, the present invention relates to a bladed disk brush roller assembly for a vacuum cleaner which generates direct and/or indirect force that moves debris, such as dirt and dust, away from the ends of the brush roller assembly including but not limited to the bearing assemblies toward the middle of the brush roller assembly where it is removed from the brush roller assembly by the suction of the vacuum cleaner.

B. Description of Related Art

Brush roller assemblies for vacuum cleaners are well known and have been described in numerous references, including a number of issued United States patents. A typical brush roller assembly includes a rotatably mounted and motor driven spindle having a brush on a cylindrical or non-cylindrical outer surface thereof and a non-rotatable mounting structure at each end to mount the brush roller assembly to a vacuum cleaner housing. While the mounting structure may vary considerably, one type of known mounting structure includes end assemblies at each end of the spindle, the end assemblies including a rotatable stub shaft, a bearing and an end cap member which is fixedly secured to the vacuum cleaner housing.

Certain problems are known to exist with known prior art of brush roller assemblies for vacuum cleaners. In particular, debris, such as dirt and dust, tends to collect in such known prior art brush roller assemblies. This is thought to be due, at least in part, to the lack of movement of air from the ends of the brush roller assembly to the central portion of the brush roller assembly where debris, such as dirt and dust, can be removed from the brush roller assembly by the vacuum of the vacuum cleaner.

II. SUMMARY OF THE INVENTION

Accordingly, an object of the present invention is the provision of an airflow enhancing device ("AED"), which includes, but is not limited to, bladed disks, fans, impellers, and other mechanical structures that increase air flow. The AED brush roller assembly for a vacuum cleaner, which facilitates the movement of debris from the ends of the brush roller assembly to the central portion of the brush roller assembly where it can be removed from the brush roller assembly by the vacuum of the vacuum cleaner assembly.

This and other objects of the present invention are attained by a brush roller assembly for a vacuum cleaner which includes a rotatable spindle having a longitudinal axis, a first end, a second end and a central portion, a first AED positioned on the first end of the rotatable spindle, the first AED including a central portion which is positioned substantially perpendicular to the longitudinal axis of the rotatable spindle when the first AED is positioned on the first end of the rotatable spindle and at least one fan blade (impeller or similar mechanical structure) projection outwardly extending from the periphery of the central portion of the first AED, the one or more fan blade projections being oriented to facilitate the movement of debris from the first end of the rotatable spindle toward the central portion of the rotatable spindle, a first end cap attached to the first end of the rotatable spindle, a second AED (impeller or similar mechanical structure) positioned on the second end of the rotatable spindle, the second AED including a central portion which is positioned substantially perpendicular to the longitudinal axis of the rotatable spindle when the second AED is positioned on the second end of the rotatable spindle and at least one fan blade projection outwardly extending from the periphery of the central portion of the second AED, the one or more fan blade projections being oriented to facilitate the movement of debris from the second end of the rotatable spindle toward the central portion of the rotatable spindle and a second end cap attached to the second end of the rotatable spindle.

Other advantages and novel features of the present invention will become apparent in the following detailed description of the invention when considered in conjunction with the accompanying drawings.

III. BRIEF DESCRIPTION OF THE DRAWINGS

IV. DESCRIPTION OF THE PREFERRED EMBODIMENT

Figure 1:
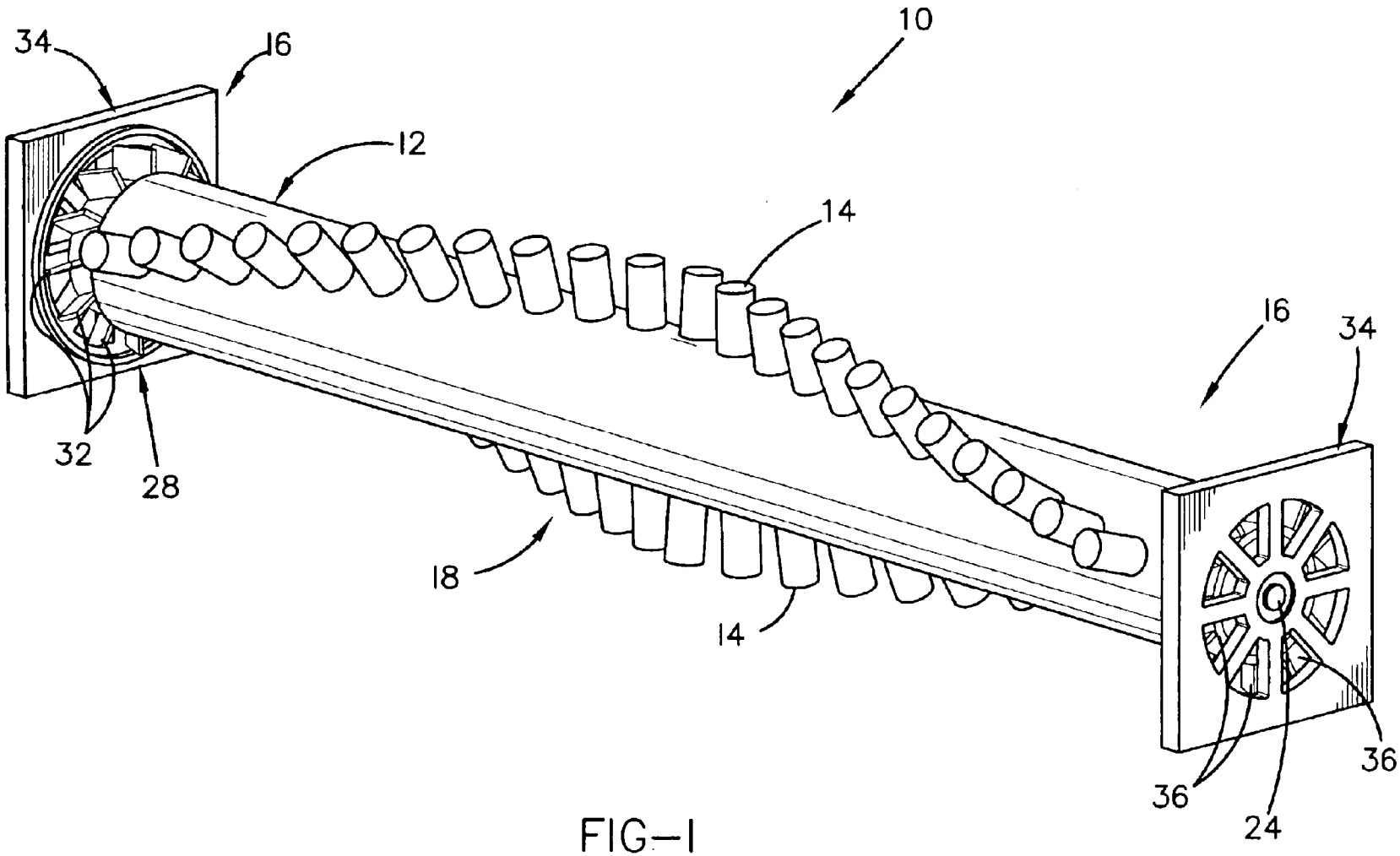
FIG. 1 is a perspective view of an AED brush roller assembly for a vacuum cleaner in accordance with a preferred embodiment of the present invention.
Figure 2:
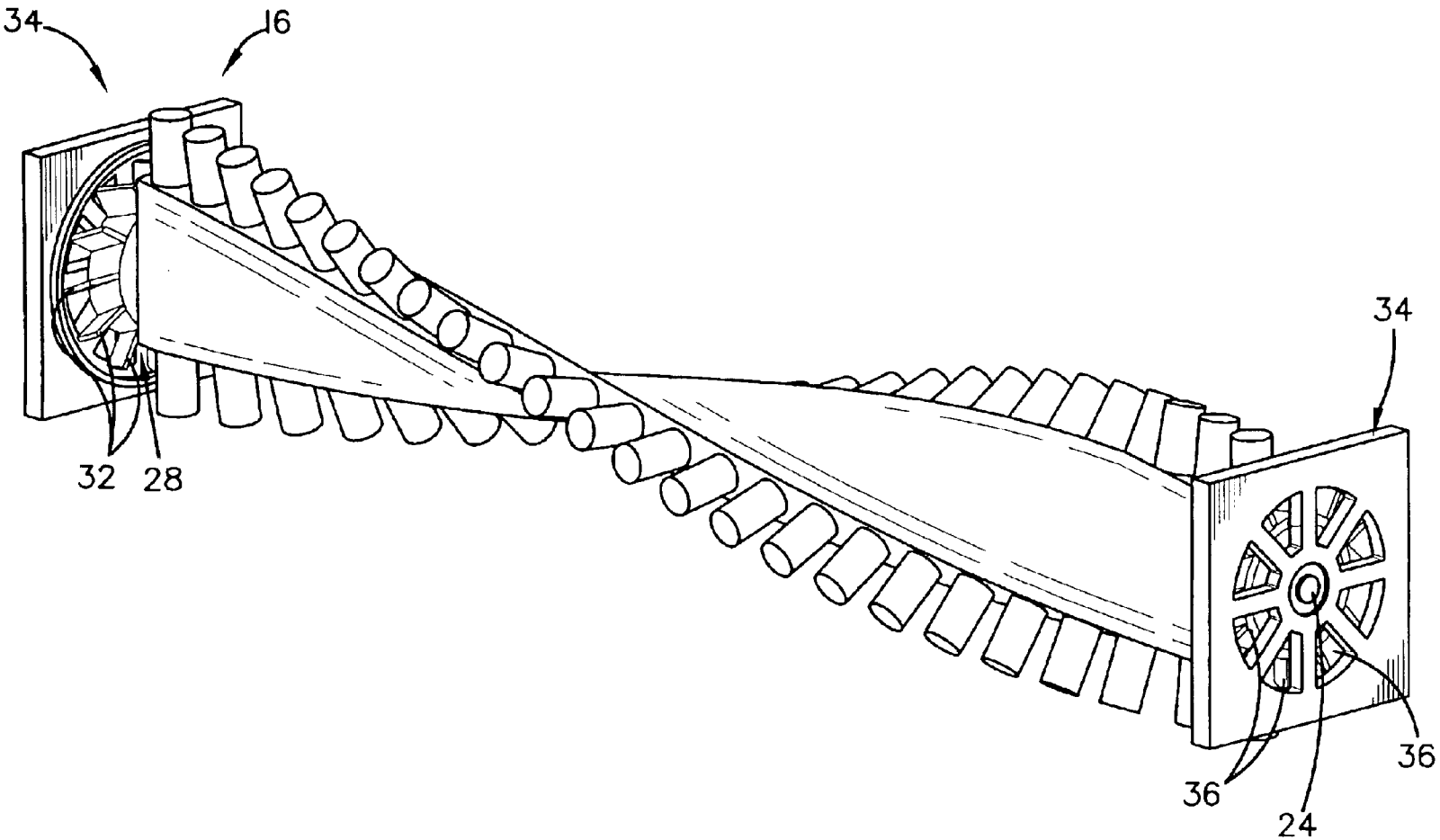
FIG. 2 is a perspective view of an AED brush roller assembly for a vacuum cleaner in accordance with another embodiment of the present invention.
Figure 3:
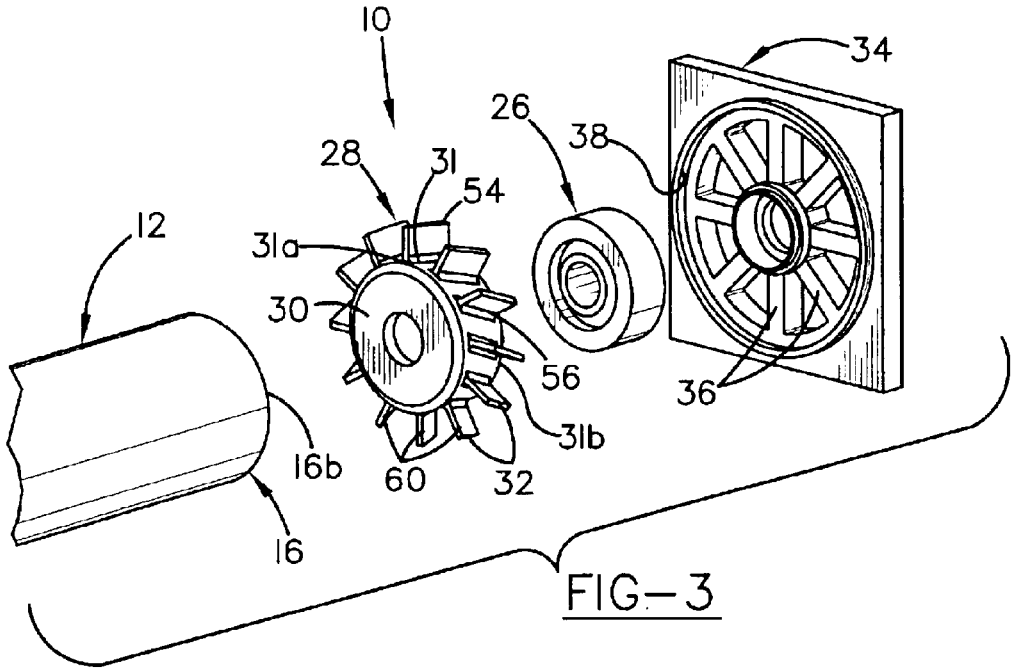
FIG. 3 is a first exploded prospective view of the preferred embodiment of an AED brush roller assembly for a vacuum cleaner in accordance with the present invention shown in FIG. 1.
Figure 4:
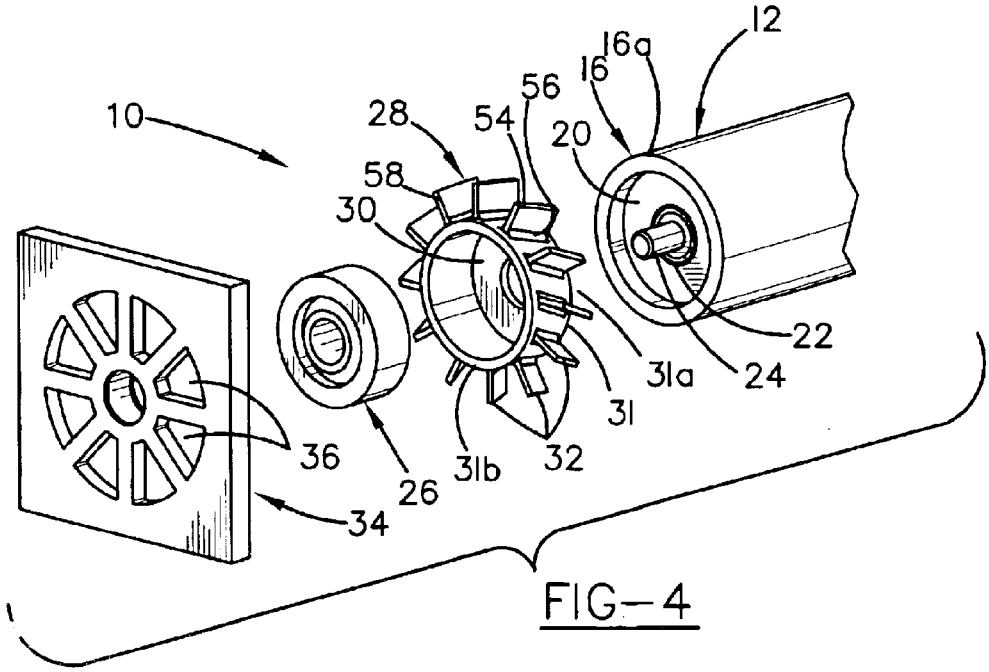
FIG. 4 is a second exploded prospective view of the preferred embodiment of an AED brush roller assembly for a vacuum cleaner in accordance with the present invention shown in FIG. 1.
Figure 5:
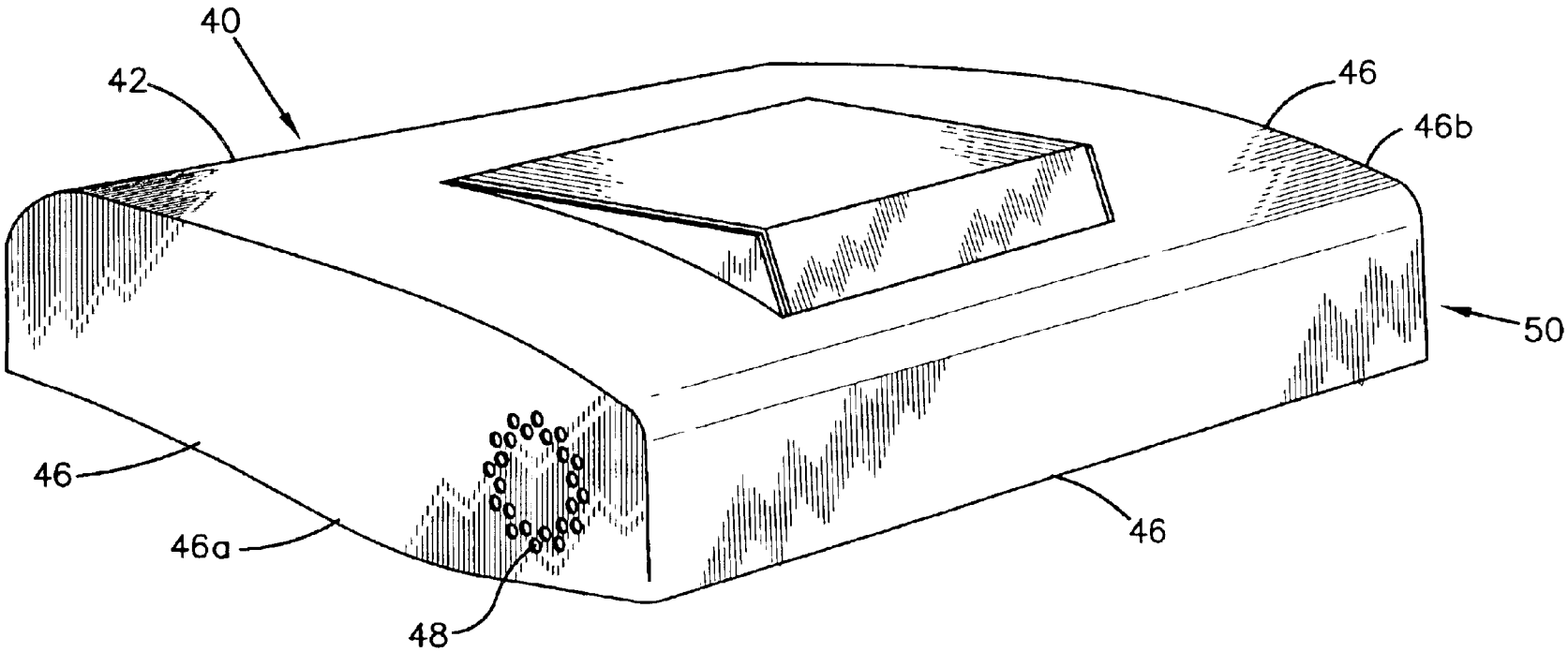
FIG. 5 is a perspective view of the housing.

In the following detailed description of a preferred embodiment of the present invention, reference is made to the accompanying drawings, which, in conjunction with this detailed description, illustrate and describe a preferred embodiment of an AED brush roller assembly for a vacuum cleaner in accordance with the present invention. Referring to FIGS. 1–4, AED brush roller assembly 10 includes rotatable spindle 12 having a generally cylindrical configuration and at least one brush 14, which is preferably positioned on the outer cylindrical surface of rotatable spindle 12. The rotatable spindle 12 may have many different geometries, including an alternate embodiment shown in FIG. 2, which is rectangular. Rotatable spindle 12 includes two (2) end portions 16, of which only one (1) is shown in FIGS. 3 and 4, and central portion 18. Rotatable spindle 12 also preferably includes recess 20 in each of end portions 16 and opening 22, which removably receives outwardly extending pin 24. Rotatable spindle 12 is preferably fabricated from wood, although, if desired, a plastic material or some other material may alternatively be used. Outwardly extending pin 24 is preferably fabricated from steel, although, if desired, some other material may be used. AED brush roller assembly 10 also preferably includes two (2) bearings 26 positioned in central portion 30 of each AED 28 and over outwardly extending pin 24 to facilitate the rotation of rotatable spindle 12.

AED brush roller assembly 10 also includes two (2) AEDs 28 positioned on each end portion 16 of rotatable spindle 12. It should be noted that the AEDs 28 may be attached to any area along the rotatable spindle 12. AEDs 28 include central portion 30 which is positioned substantially perpendicular to the longitudinal axis of rotatable spindle 12 when AEDs 28 are placed on end portions 16 of rotatable spindle 12 and at least one fan blade projection 32 outwardly extending from the periphery of central portion 30 of AEDs 28. More specifically, the periphery is a lip 31 extending from the central portion 30, wherein the lip has a first side 31*a* adjacently located to the central portion and a second side 31*b*, which is distally located from the first side 31*a*. The one or more fan blade projections 32 of AEDs 28 are preferably oriented at an angle relative to central portion 30 of AEDs 28 to facilitate the movement of outside air from end portions 16 of rotatable spindle 12 toward central portion 18 of rotatable spindle 12 where outside air, as well as any debris 70, such as dirt and dust, carried with the outside air, is removed from AED brush roller assembly 10 by the air flow of the vacuum cleaner. Each blade projection 32 has a top 54 and a bottom 56. Further each blade 32 has a first face 58, which is flush with the second side 32*b* of the lip 31. Each blade 32 also has a second face 60, which may extend approximately midway across the lip 31. The angle of one or more fan blade projections 32 of AEDs 28 relative to central portion 30 of AEDs 28 is preferably in the range of zero (0) to ninety (90) degrees and is most preferably approximately twenty (20) degrees. Each blade projection 32 may have substantially the same cross sectional shape from the top 54 of the blade 32 to the bottom 56 of the blade 32. The angle of the top 54 and bottom 56 of the blade projections 32 relative to the central portion 30 may be equal. AEDs 28 are preferably fabricated from a plastic material, or alternatively, are fabricated as sheet metal stampings, although, if desired, other materials may be used.

As previously described, the airflow enhancing device ("AED") may take the form of a bladed disk. Alternatively, the AED may take the form of any structural device that increases airflow, including, but not limited to fans and impellers.

Figure 6:
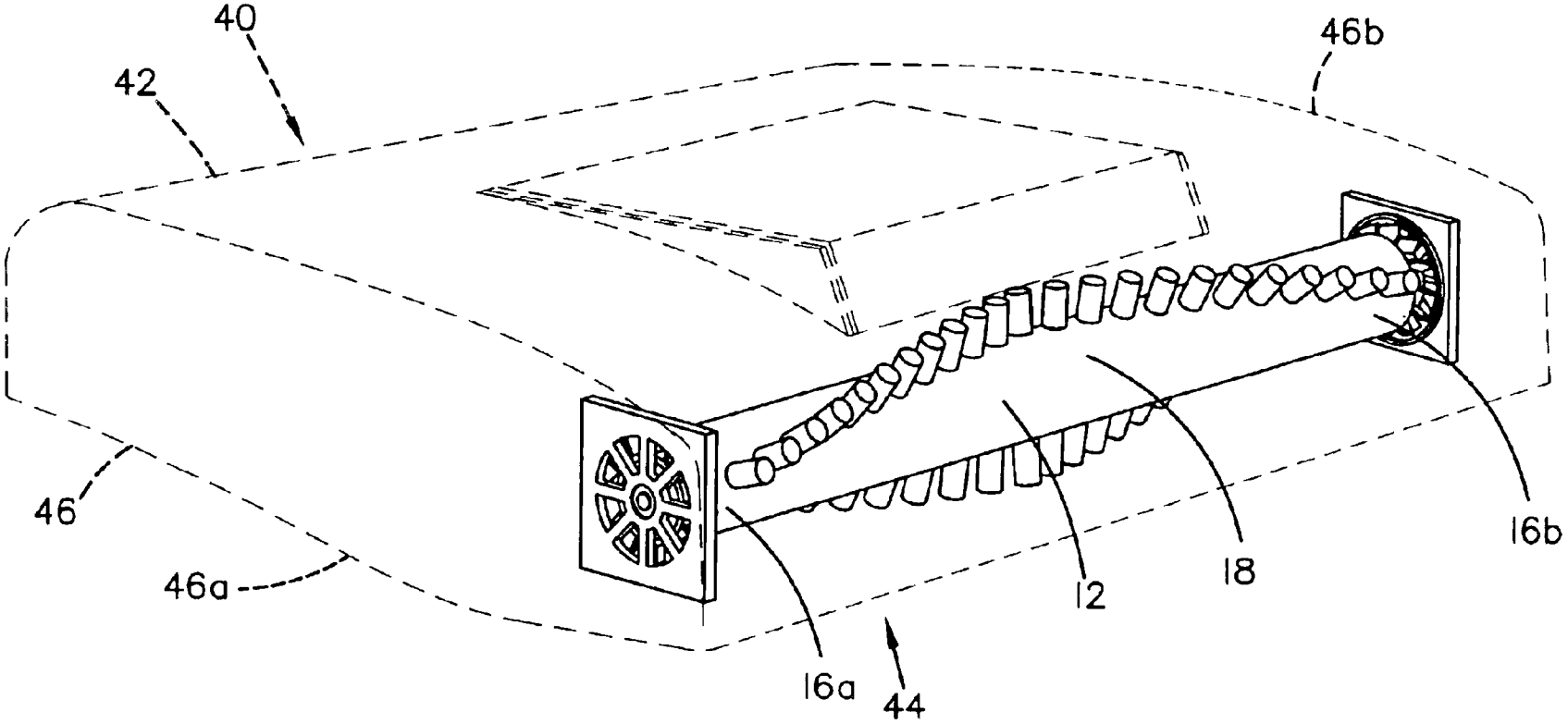
FIG. 6 is a perspective view of the housing showing the rotatable spindle.
Figure 7:
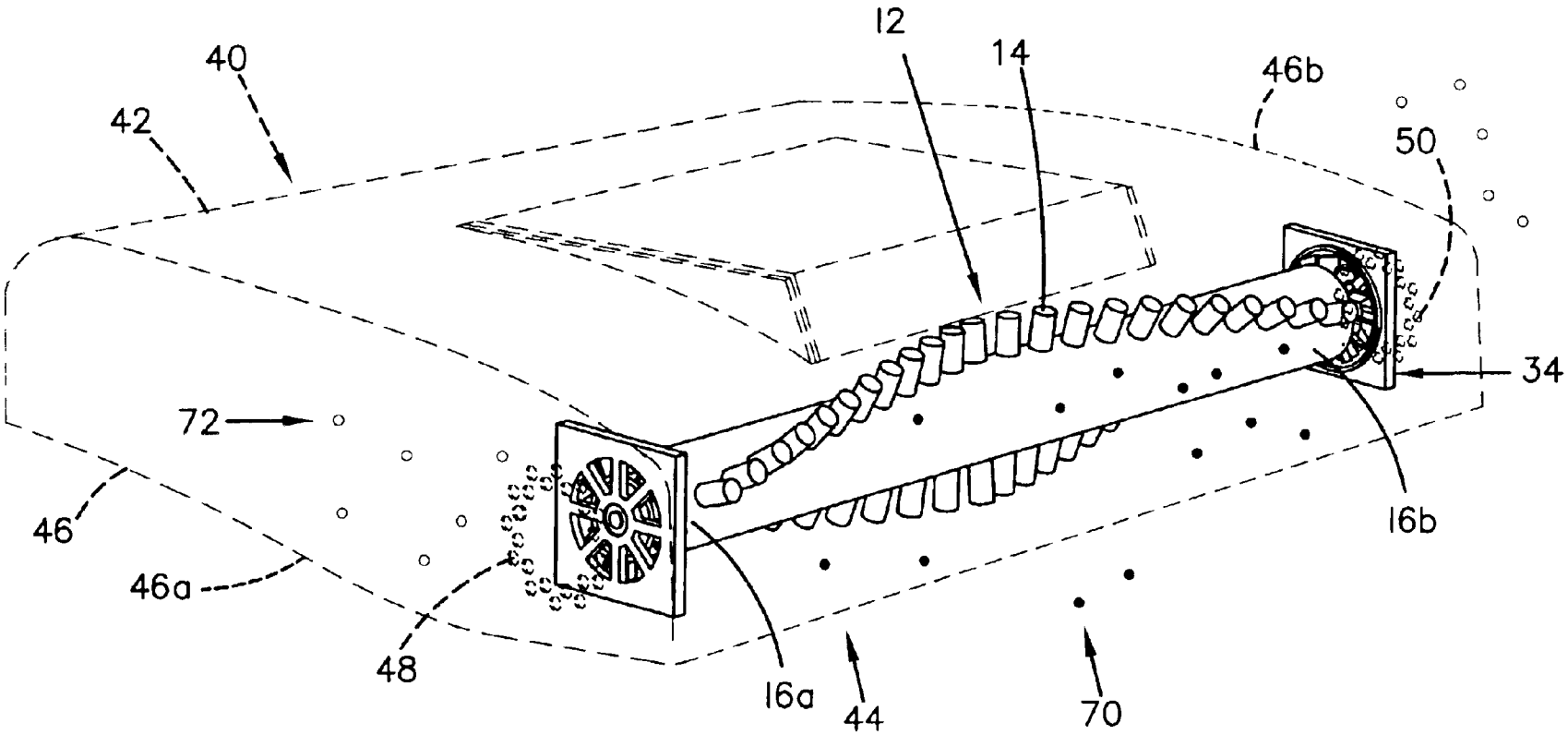
FIG. 7 is a perspective view of the rotatable spindle.
Figure 8:
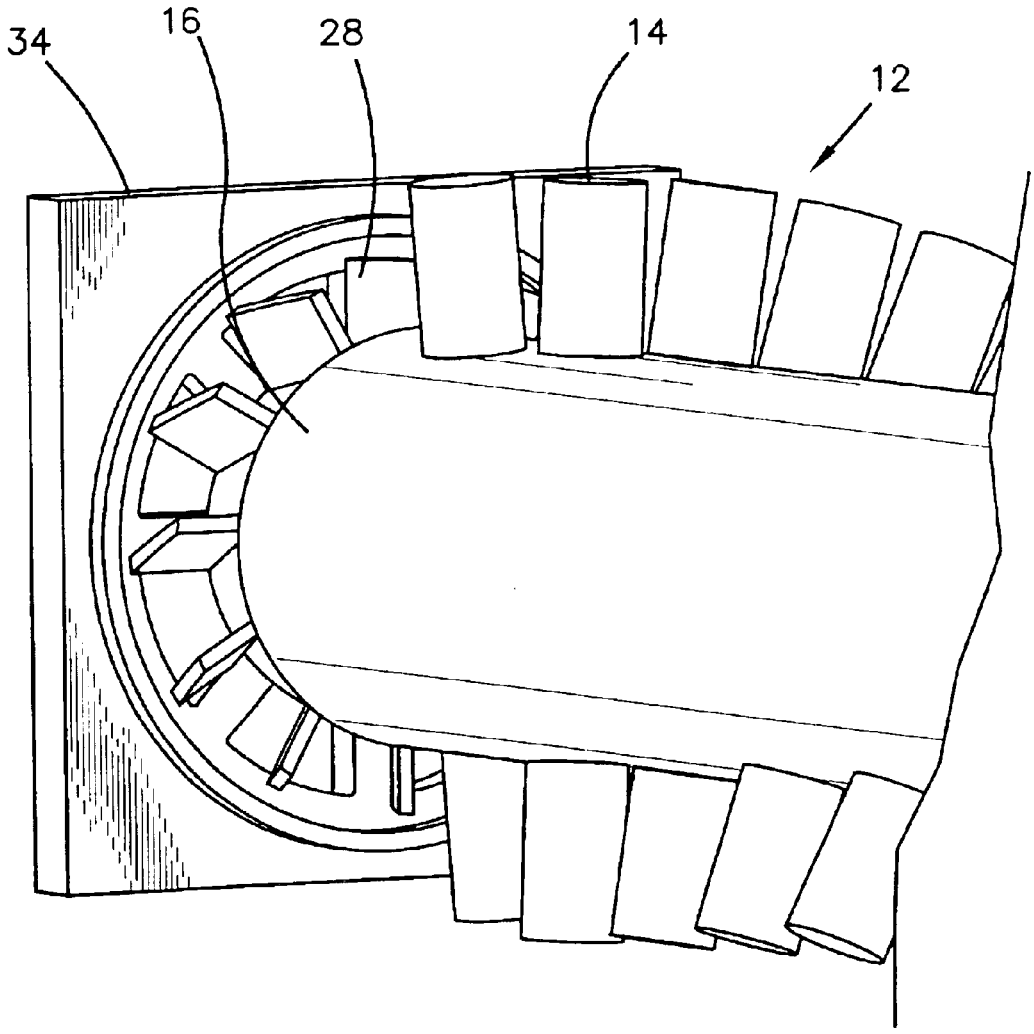
FIG. 8 is an enlarged perspective view of the rotatable spindle shown in FIG. 1.
Figure 9:
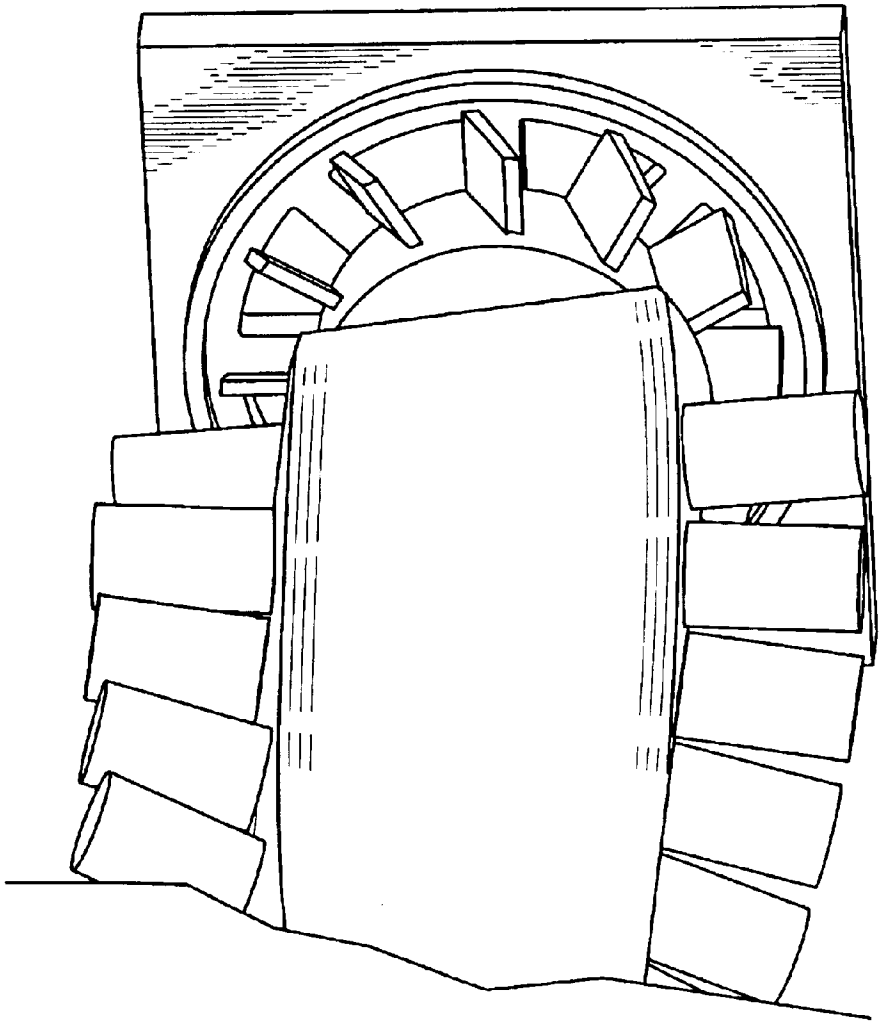
FIG. 9 is an enlarged perspective view of the rotatable spindle shown in FIG. 2.

AED brush roller assembly 10 also includes two (2) end caps 34 attached to bearings 26 in such a manner as to permit rotation of rotatable spindle 12 and AEDs 28. End caps 34 preferably include at least one opening, and more preferably a plurality of openings 36 elongated in a radial direction positioned in a circular configuration approximately corresponding to the position of one or more fan blade projections 32 on AEDs 28, to facilitate the movement of outside air from end portions 16 of rotatable spindle 12 toward central portion 18 of rotatable spindle 12 where outside air, as well as any debris 70 (FIG. 6), such as dirt and dust, carried with the outside air, is removed from AED brush roller assembly 10 by the airflow of the vacuum cleaner. End caps 34 preferably include recess 38 and AEDs 28 are preferably positioned, at least in part, in recess 38 of end caps 34. In addition, a portion of central portion 30 of the AEDs 28 may be positioned in recess 20 in end portions 16 of rotatable spindle 12. The AED 28 may be operationally connected in a variety of ways, including but not limited to, insertion in recess 20, screwed onto the brush roller assembly 10 and/or molded into the brush roller assembly 10. End caps 34 are preferably fabricated from a plastic material, although, if desired, other materials may be used to fabricate end caps 34. In addition, if desired, rotatable spindle 12 and AEDs 28 could be fabricated as an integral integrated assembly.

Figure 10:
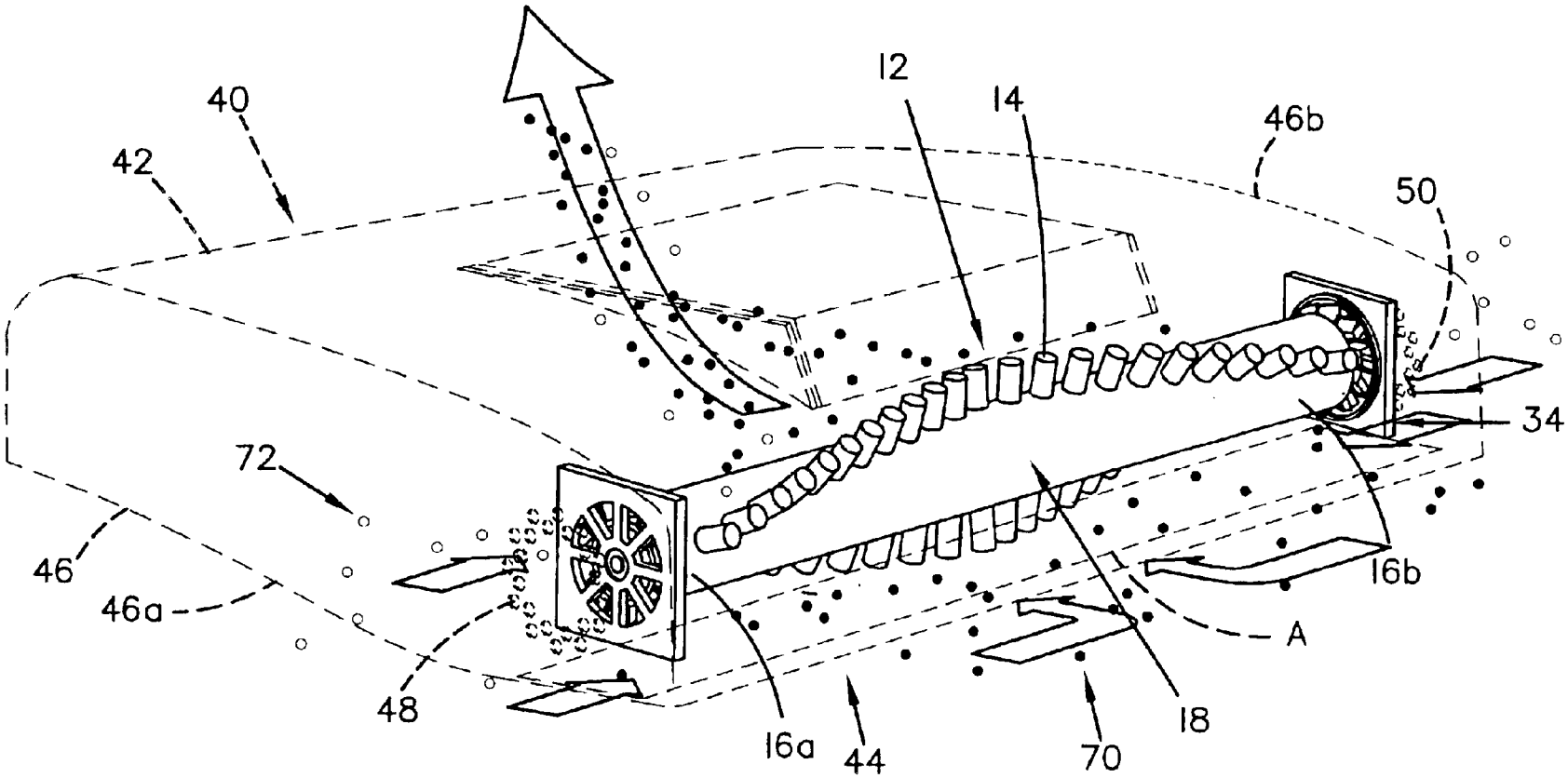
FIG. 10 is a perspective view of the rotatable spindle showing the direction of airflow.

With reference to FIGS. 5–16, several alternative embodiments of the present invention will now be described. It should be understood that the end caps 34 previously described may be utilized in connection with the embodiments described below if desired. The brush roller assembly 10 is enclosed by a housing 40 having a top 42, a bottom 44 and sidewalls 46. The housing 40 should have at least one opening 48 in sidewall 46*a* and a second opening 50 in sidewall 46*b*. The first end 16*a* of the rotatable spindle 12 is laterally spaced from the first opening 48, and the second end 16*b* of the rotatable spindle 12 is laterally spaced from the second opening 50. As such, air is adapted to enter the housing through the first and second openings 48, 50 and travel along the longitudinal axis towards the central portion 18 of the rotatable spindle 12 so as to increase air flow and aid in the removal of debris 70, which is best seen in FIG. 10. It should be noted that the air entering the first and second openings 48, 50 will generally be clean, meaning substantially uncontaminated by debris 70. Because of the airflow through the first and second openings 48, 50, debris to be collected near the side walls 46 is conveyed to the central portion 18, thus, enhancing edge cleaning.

Figure 11:
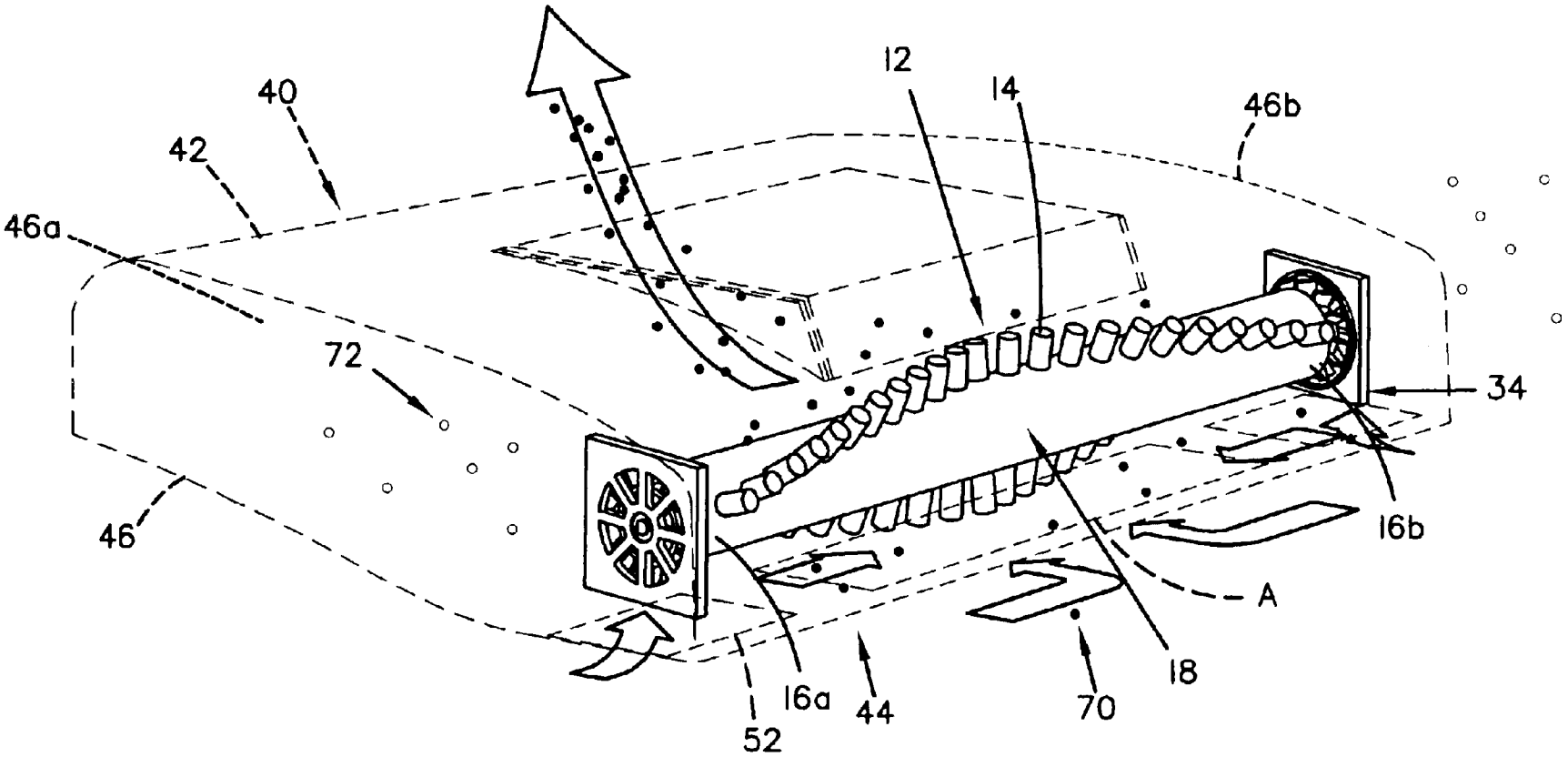
FIG. 11 is another embodiment of the present invention showing openings in the bottom of the housing.

With reference to FIGS. 10 and 11, another embodiment of the present invention is shown. In this embodiment, the bottom 44 of the housing 40 has one or more openings or apertures 52 in addition to a primary central opening A. Although not required, it is preferred that the openings 52 in the bottom 44 of the housing 40 be positioned in close proximity to the sidewalls 46. With this configuration, air enters through the bottom apertures 52 outboard of end caps 34 and travels along the longitudinal axis rotatable spindle to the central portion 18. Air entering the housing 40 from the bottom aperture 52 will most likely be contaminated with debris 70. In this embodiment, the sidewalls 46*a*, 46*b*, may have the first and second openings 48, 50 to simultaneously draw in clean air 72 during operation. Further, this embodiment may utilize the AED 28 as previously described or no AED. Edge cleaning is also enhanced in this embodiment.

Figure 12:
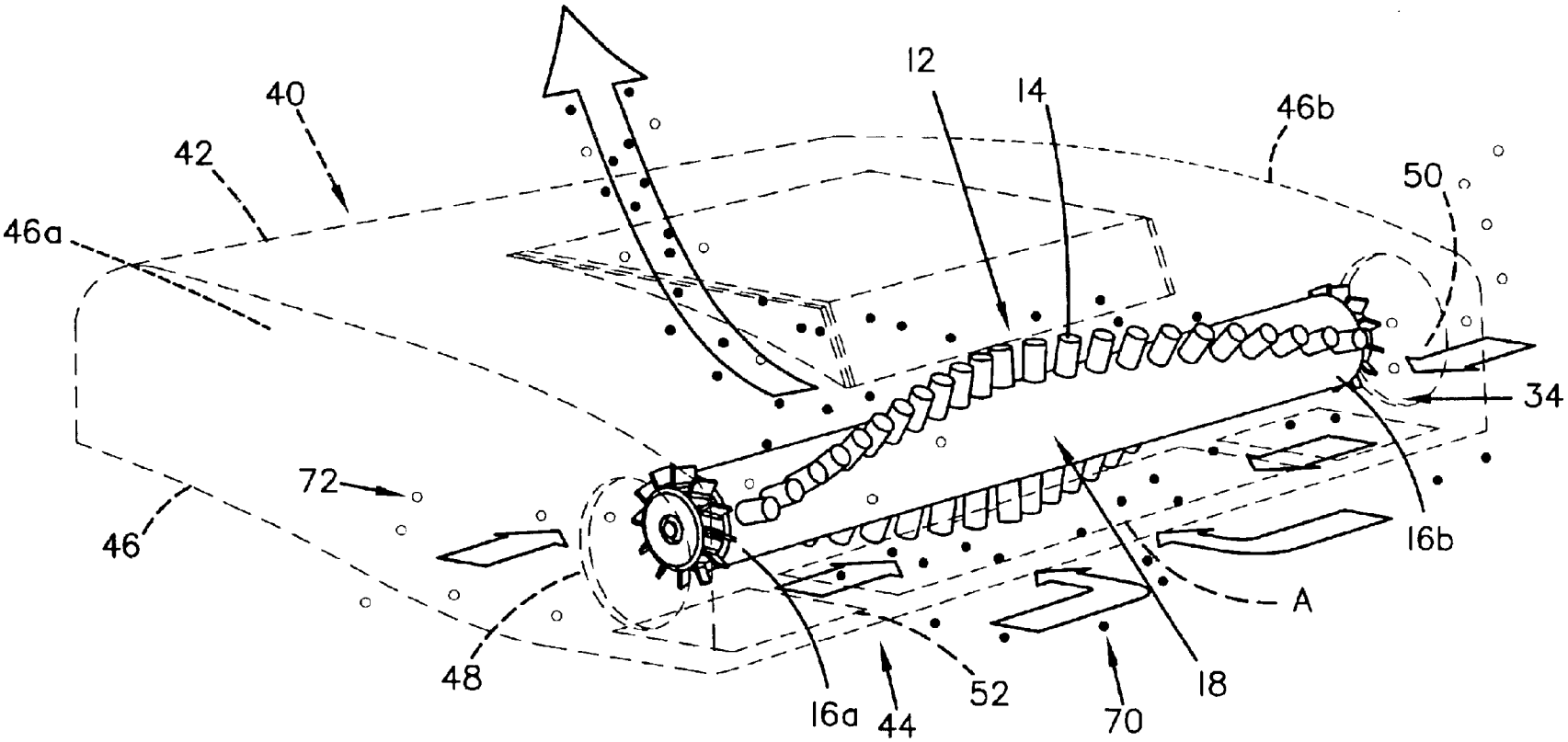
FIG. 12 is yet another embodiment of the present invention showing completely open openings in the sidewalls of the housing, which may also be adjustable.

FIG. 12 shows yet another embodiment of the present invention. In this embodiment the first and second openings 48, 50 are completely open, meaning there are no subdivisions as shown in FIGS. 1–3. Further, there are no obstructions, such as a brush, between the sidewall openings

48, 50 and the ends 16 of the rotatable spindle 12. Air entering the housing enters the openings 48, 50 and flows directly to an area in close proximity to one of the corresponding end 16*a*, 16*b*, of the rotatable spindle 12 toward the central portion 18. In this configuration, airflow input is greatly enhanced, as well as edge cleaning.

Figure 13:
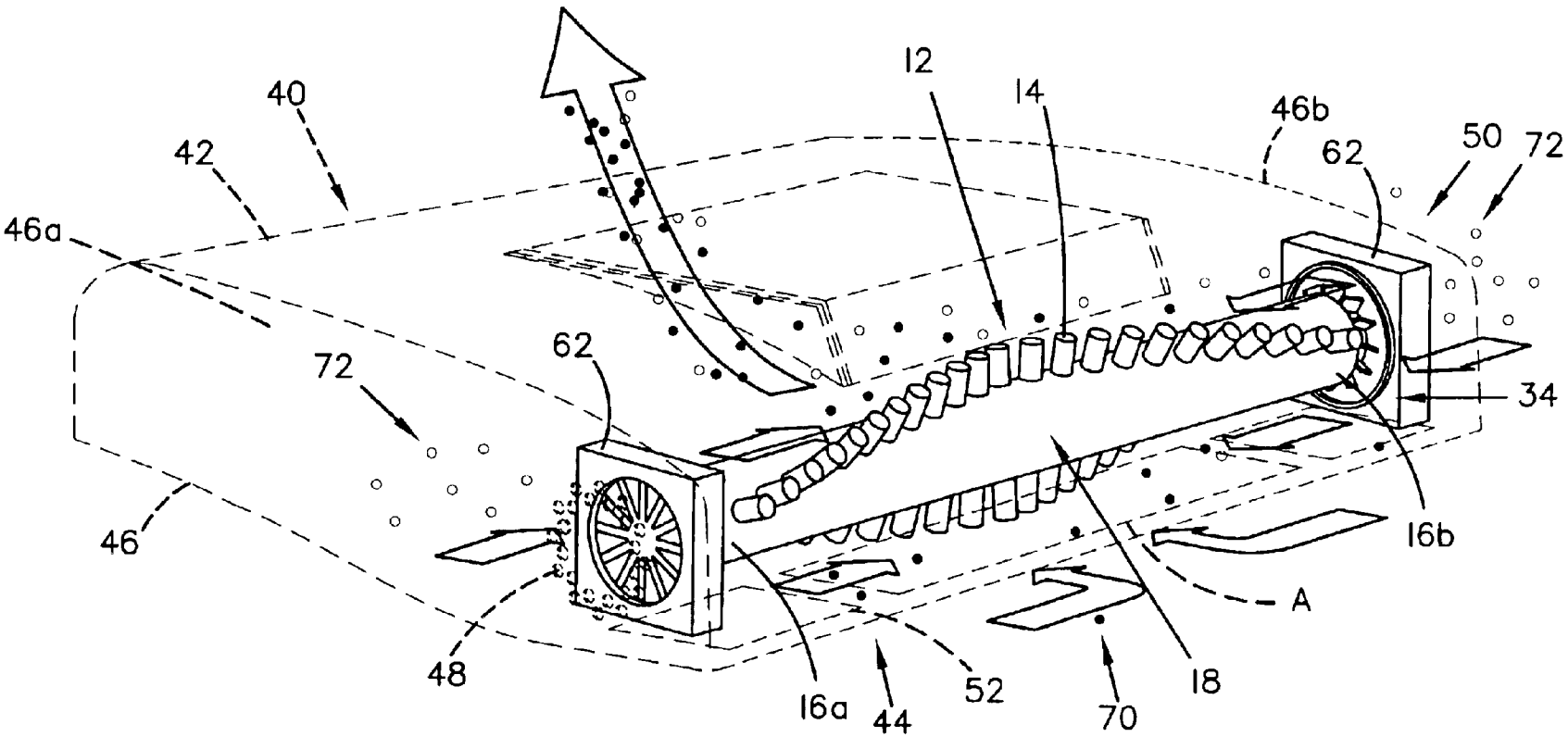
FIG. 13 is still another embodiment of the present invention showing another embodiment of the airflow enhancement device in communication with the rotatable spindle to increase forced airflow through the housing.

With reference to FIG. 13, another embodiment of the present invention is illustrated. In this embodiment, an airflow adjustment mechanism 62 takes the form of a pressurization mechanism, such as but not limited to a pressurized fan, is in airflow communication with one of the ends 16 of the rotatable spindle 12. The airflow adjustment mechanism 62 may be attached to the housing or the rotatable spindle through any means known in the art. The forced airflow may utilize the normal exhaust from the main vacuum in combination with appropriate ducting (not shown). As with the other embodiments, this embodiment increase forced airflow from outside the housing, down the longitudinal axis of the rotatable spindle 12 towards the central portion 18.

Figure 14:
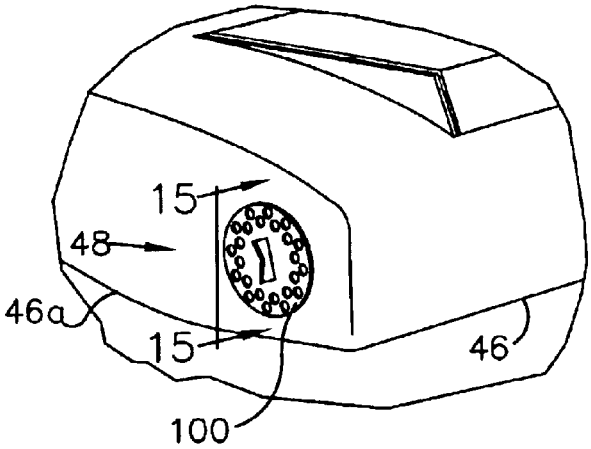
FIG. 14 is another embodiment of the present invention showing adjustable openings in the sidewalls of the housing.
Figure 15:
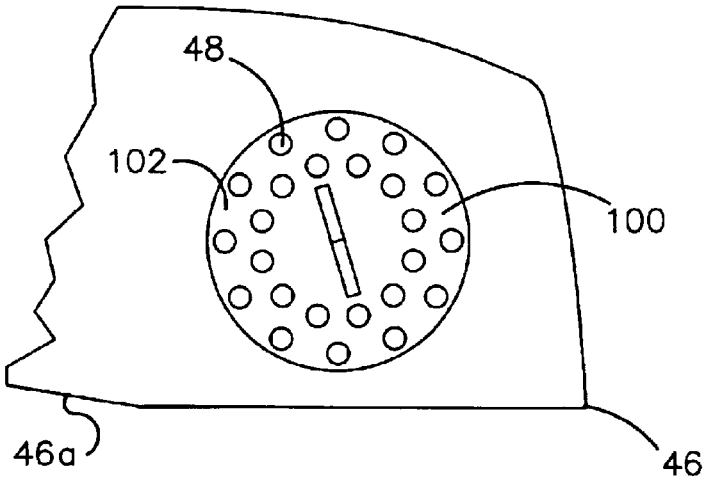
FIG. 15 is a side view of FIG. 14 showing the adjustment mechanism in the open position to enable airflow.
Figure 16:
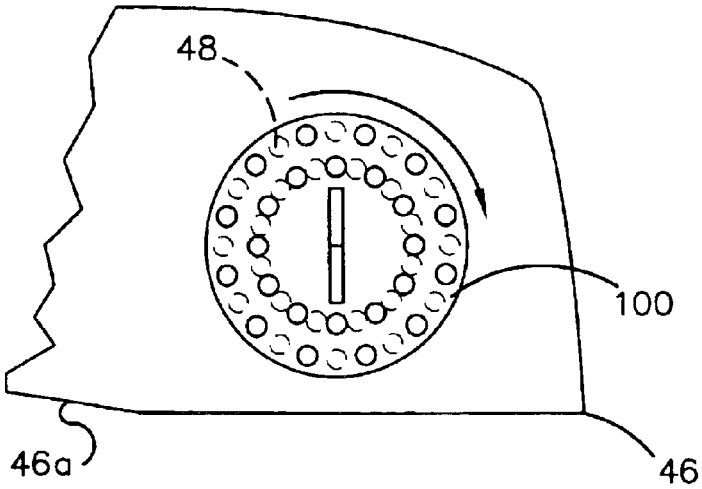
FIG. 16 is a side view of FIG. 14 showing the adjustment mechanism in the closed position, which prevents airflow.

FIGS. 14–16 show yet another embodiment of the present invention. In this embodiment the first and second openings 48, 50 are adjustable. An adjustment mechanism 100 is shown which varies the size of the openings 48, 50. The adjustment mechanism 100 may be any device, but not limited to a movable plate 102, as shown in FIG. 15. The movable plate 102 may be rotated to vary the size of the openings 48, 50. When the adjustment mechanism 100 is in a first position, as shown in FIG. 15, air entering the housing enters the openings 48, 50 and flows directly to an area in close proximity to one of the corresponding end 16*a*, 16*b*, of the rotatable spindle 12 toward the central portion 18. Whereas, when the adjust mechanism 100 is in a second position, as shown in FIG. 16, the openings 48, 50 are closed an air cannot pass through. The adjustment mechanism 100 may be moved to any position between completely open and completely closed in order vary and achieve the desired airflow.

Accordingly, although the present invention has been described above in detail, the same is by way of illustration and example only and is not to be taken as a limitation on the present invention. It is apparent to those having a level of ordinary skill in the relevant art that other variations and modifications in AED brush roller assembly for a vacuum cleaner in accordance with the present invention, as described and shown herein, could be readily made using the teachings of the present invention. Accordingly, the scope and content of the present invention are to be defined only by the terms of the appended claims.

What is claimed is:

1. An apparatus, comprising:

a housing having a top, a bottom, a center, sidewall, a first, a second and a third opening, said first opening located within the center of said housing, said second, third openings located adjacent said sidewalls of said housing, said first, second and third opening in said bottom of said housing;

a rotatable spindle positioned within the housing, the rotatable spindle having a longitudinal axis, a first end, a second end and a central portion, the first end being laterally spaced from the first opening of the housing, the second end being laterally spaced from the second opening of the housing, said first and second ends corresponding with said second and third openings of said housing;

an airflow enhancing device comprising at least one blade and located at said first end of said rotatable spindle and having a central portion which is positioned substantially perpendicular to the longitudinal axis of the rotatable spindle wherein debris enters through at least said second opening of said housing, directly impinges said airflow enhancing device and travels along the longitudinal axis towards the central portion of the rotatable spindle.

2. The apparatus of claim 1, wherein the airflow enhancing device is integrally molded into said rotatable spindle.

3. The apparatus of claim 1, wherein the airflow enhancing device is physically attached to said rotatable spindle.

4. The apparatus of claim 3, wherein the airflow enhancing device is attached to said rotatable spindle by screws.

5. The apparatus of claim 3, wherein the airflow enhancing device is attached to said rotatable spindle by being pressed onto a stub shaft.

6. The apparatus of claim 1, wherein the blade is angled relative to said central portion of the airflow enhancing means to facilitate the movement of outside air from said first end of said rotatable spindle toward the central portion of said rotatable spindle.

7. The apparatus of claim 1, wherein the airflow enhancing device comprises at least one blade oriented at an angle between zero (0) degrees and ninety (90) degrees relative to the central portion of the airflow enhancing means to facilitate the movement of debris toward the central portion of said rotatable spindle.

8. The apparatus of claim 1, further comprising a second airflow enhancing device having a central portion which is positioned substantially perpendicular to the longitudinal axis of the rotatable spindle when the second airflow enhancing device is placed on said second end of the rotatable spindle, wherein debris is acted upon to directly impinge said first and said second airflow enhancing devices and travel along their respective longitudinal axis towards the central portion of the rotatable spindle.

* * * * *